US006784772B1

(12) United States Patent
Brandon et al.

(10) Patent No.: US 6,784,772 B1
(45) Date of Patent: Aug. 31, 2004

(54) ELECTRIC SOLENOID WITH ADAPTABLE CONNECTORS AND MOUNTINGS

(76) Inventors: Dennis Brandon, 5114 Woodland Hills Dr., Brentwood, TN (US) 37027; Michael L. Mullins, 2708 Antiqua Cir., Thompson's Station, TN (US) 37179; Thomas G. Holder, 4231 Holder Rd., Franklin, TN (US) 37067

( * ) Notice: Subject to any disclaimer, the term of this patent is extended or adjusted under 35 U.S.C. 154(b) by 0 days.

(21) Appl. No.: 10/420,173

(22) Filed: Apr. 22, 2003

(51) Int. Cl.[7] ..... H01F 7/00

(52) U.S. Cl. ..... 335/78; 335/202; 336/65; 336/67; 336/107; 336/192

(58) Field of Search ..... 335/78–86, 106–137, 335/202, 255–278; 336/65–68, 90, 105, 107, 192

(56) References Cited

U.S. PATENT DOCUMENTS 3,324,431 A * 6/1967 Cataldo et al. ..... 335/132
4,521,758 A 6/1985 Krubsack
6,515,565 B1 2/2003 Muramatsu et al.

* cited by examiner

*Primary Examiner*—Ramon M. Barrera
(74) *Attorney, Agent, or Firm*—W. Edward Ramage

(57) ABSTRACT

An electric solenoid with adaptable terminals and posts to connect to a variety of different electric connectors, and with a multiple-eared mounting plate permitting mounting in a variety of configurations. The solenoid posts combine internally-threaded female post receptors integrally molded into the solenoid casing, with removable post studs, one end of which is threaded to screw into the respective female post receptor. The other end of the removable post studs are also threaded, and can be formed in a variety of different sizes to accommodate a variety of connectors as needed for a particular application. The energizing terminal (and ground terminal, if present) can accommodate a variety of connector types, including eyelet leads, push-on connectors, and spade connectors.

16 Claims, 7 Drawing Sheets

ELECTRIC SOLENOID WITH ADAPTABLE CONNECTORS AND MOUNTINGS

APPLICATION FOR UNITED STATES LETTERS PATENT

Be it known that we, Dennis Brandon, a citizen of the United States, residing at 5114 Woodland Hills Drive, Brentwood, Tenn. 37027, Michael L. Mullins, a citizen of the United States, residing at 2708 Antiqua Circle, Thompson's Station, Tenn. 37179, and Thomas G. Holder, a citizen of the United States, residing at 4231 Holder Road, Franklin, Tenn. 37067, have invented a new and useful "Electric Solenoid with Adaptable Connectors and Mountings."

BACKGROUND OF THE INVENTION

This invention relates generally to an electric solenoid for starting internal combustion engines, and more particularly to an electric solenoid with adaptable terminals and posts to connect to a variety of different electric connectors, and with a multiple-eared mounting plate permitting mounting of the solenoid in a variety of configurations.

The use of standard electric solenoids for starting internal combustion engines, such as in automobiles, trucks, lawn mowers, tractors, leaf blowers, and other outdoor or recreational power equipment, is well-known. The configuration of the electric solenoids used varies widely depending on the particular application. Variations include differences in the size and number of the posts and terminals on the solenoid, the method of connecting leads and wires to the posts and terminals, and the mounting configuration of the solenoid. These variations require suppliers and users of replacement solenoids to stock, maintain, and use a wide variety of different replacement solenoids. This results in higher costs and difficulty in maintaining adequate stock for suppliers, and in potential confusion and errors in purchasing and installing replacement solenoids by the user.

Thus, what is needed is an electric solenoid that can be adapted to replace a wide variety of existing solenoid configurations, reducing costs and complexity for suppliers and users of electric solenoids.

SUMMARY OF THE INVENTION

This invention is directed to an electric solenoid with adaptable terminals and posts to connect to a variety of different electric connectors, and with a mounting plate permitting mounting of the solenoid in several different configurations. The present invention is particularly described in connection with application as a starter solenoid for outdoor and recreational power equipment and vehicles, but may of course be used in any application where an electric solenoid is used.

Generally, a typical solenoid consists of a molded housing containing electric circuitry, a pair of fixed posts extending from the top of the housing, and an energizing terminal extending from the base (or mounting) flange of the housing. If the solenoid is externally grounded, a grounding terminal also may extend from the base flange of the housing. The bottom end of the housing is affixed to a mounting plate, which typically has outwardly-extending mounting ears for convenient bolting to the frame of the equipment or vehicle.

In one exemplary form, the present invention improves upon the above-described typical solenoid by replacing the fixed posts with a combination of an internally-threaded female post receptor, which is integrally molded into the solenoid casing, and a removable post stud, one end of which is threaded to screw into the female post receptor. The other end of the removable post stud is also threaded, and can be formed in a variety of different sizes to accommodate a variety of connectors as needed for a particular application.

In another exemplary form, the energizing terminal is modified so as to accommodate a variety of connector types, including eyelet leads, push-on connectors, and spade connectors. A ground terminal can also be added, likewise modified to accommodate the various types of connectors.

In another exemplary form, the mounting plate is modified to include multiple mounting ears so the solenoid can be mounted in several different locations. A single mounting plate thus can be used to attach a solenoid in either a bottom or back mount configuration, for example.

Thus, the invention in its various forms possesses several favorable characteristics relative to the basic fixed-post solenoids described above. A single solenoid with adaptable connectors and mountings can replace several different solenoids with fixed posts and single location mounts by accommodating different connectors and mounting configurations, thus reducing confusion, inventory requirements, and costs.

Still other advantages of various embodiments will become apparent to those skilled in this art from the following description wherein there is shown and described exemplary embodiments of this invention simply for the purposes of illustration. As will be realized, the invention is capable of other different aspects and embodiments without departing from the scope of the invention. Accordingly, the advantages, drawings, and descriptions are illustrative in nature and not restrictive in nature.

DESCRIPTION OF THE EXEMPLARY EMBODIMENTS

Figure 1:
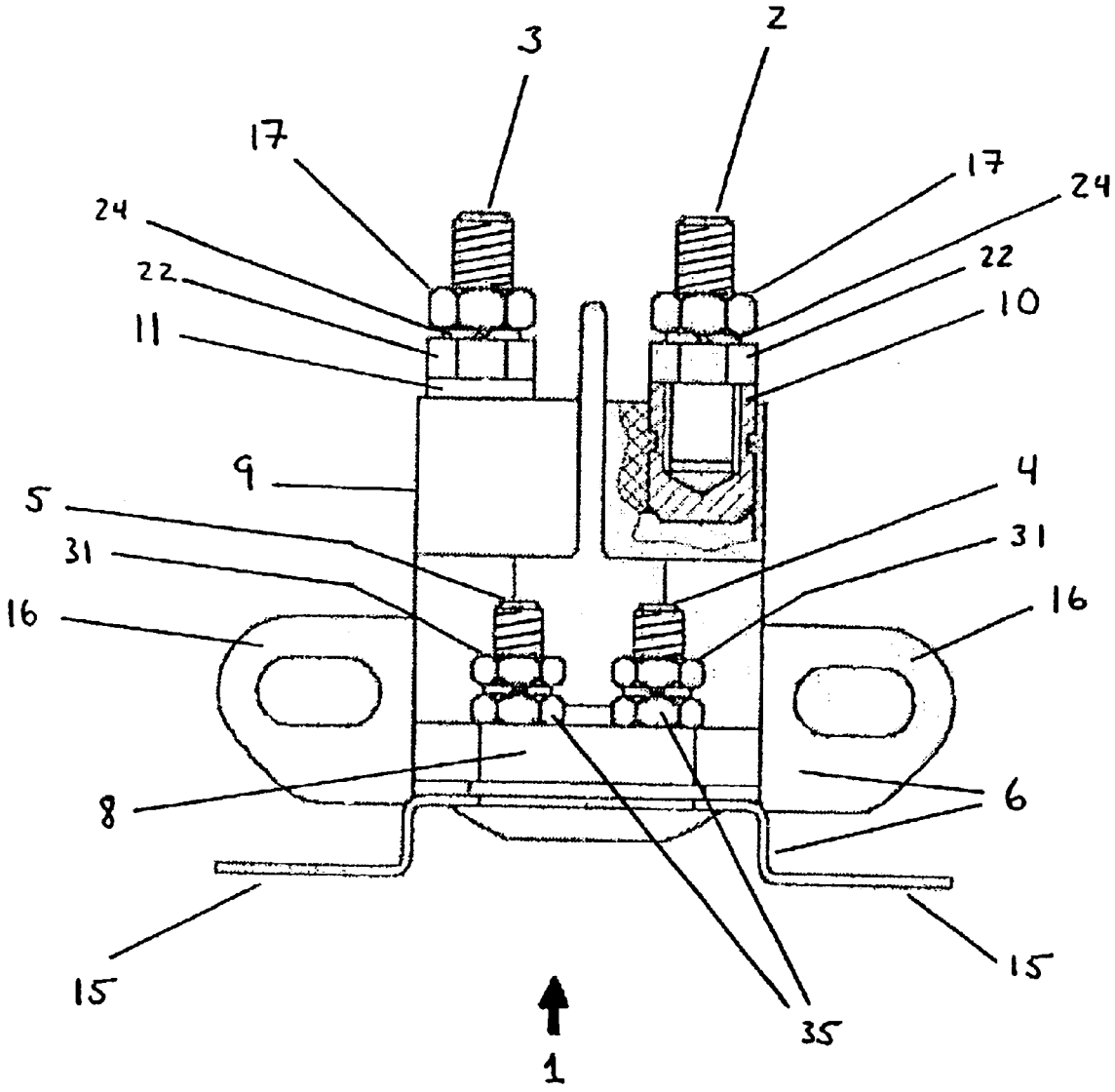
FIG. 1 is a frontal view of a solenoid with an energized and ground terminal, showing a cutaway section of one female post receptor with a removable post stud in place.

FIG. 1 shows the general configuration of an electric solenoid 1 construed in accordance with principles of the invention. The illustrated solenoid includes two removable post studs 2, 3 extending from the top of the solenoid housing 9, an energizing terminal 4 and a ground terminal 5 extending from the base flange 8 of the solenoid housing 9, and a multiple-ear mounting plate 6 affixed to the bottom of the solenoid housing 9. The two removable post studs 2, 3 are screwed into the two female post receptors 10, 11 recessed into the top of the solenoid housing 9.

Figure 5:
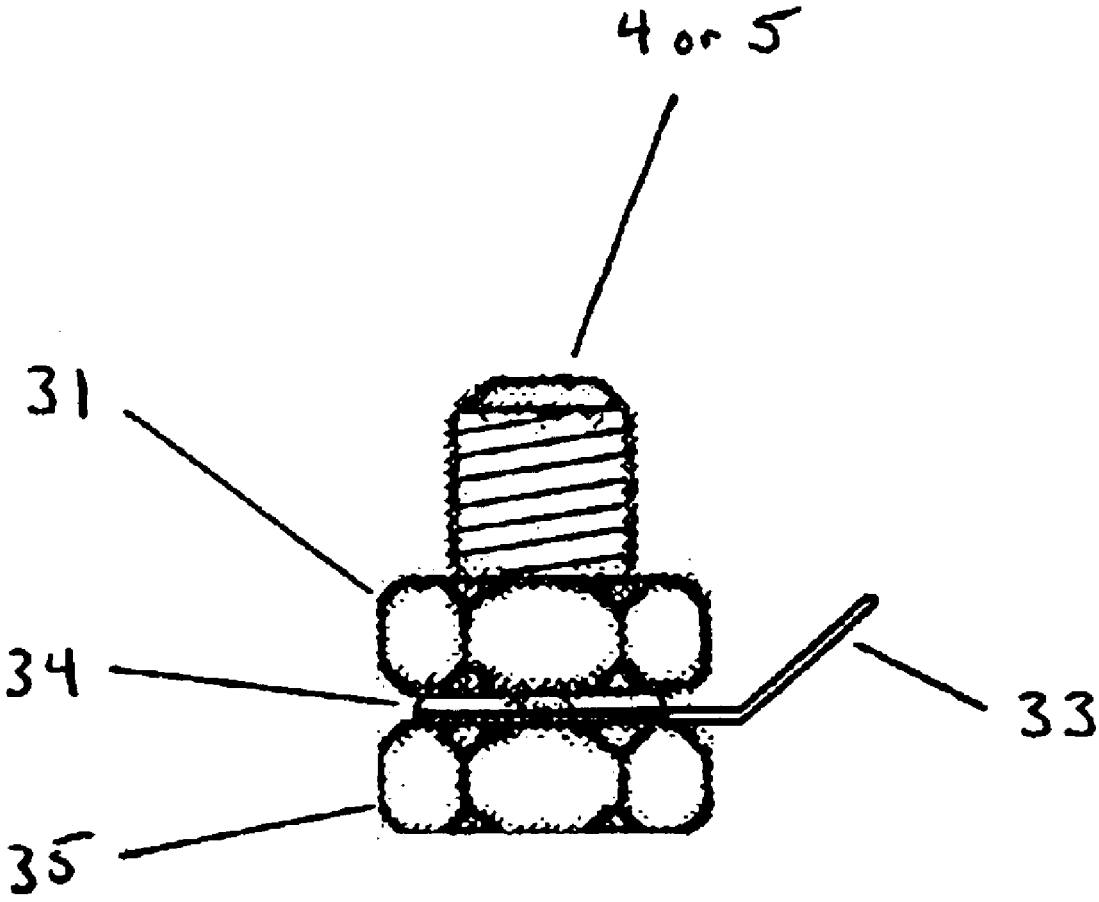
FIG. 5 is an enlarged side view of a energizing or ground terminal.

The energizing terminal 4 and a ground terminal 5 extending from the base flange 8 of the solenoid housing 9 are threaded. The terminals can accommodate a push-on connector (not shown) pushed onto a bare terminal, or an eyelet connector (not shown) placed over the terminal and secured by an appropriately-sized nut 31. An appropriately-sized nut may also be used at the base of the terminal 35 . As shown in FIG. 5, a spade tab 33 also can be fastened to either terminal, or both, to accommodate a spade connector (not shown).

The mounting plate 6 shown in FIG. 1 has four outwardly-extending mounting ears 15, 16 for convenient bolting of the solenoid 1 to a vehicle or equipment frame. The bottom mounting ears 15 are used where the solenoid is bottom-mounted. The back mounting ears 16 are used for configurations where the solenoid is back-mounted.

Figure 2:
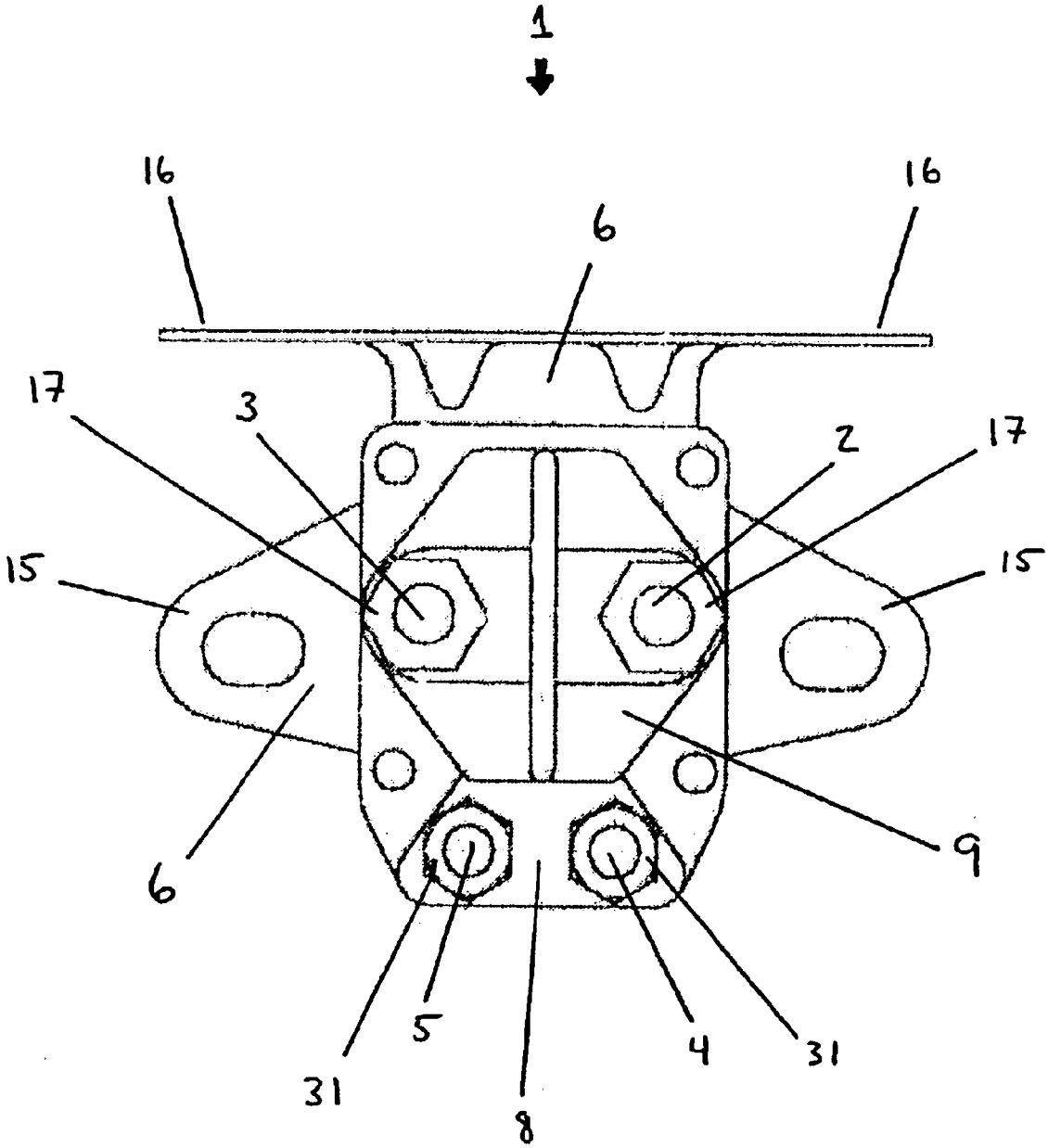
FIG. 2 is a plan view of the solenoid shown in FIG. 1.

FIG. 2 shows the solenoid 1 of FIG. 1 in plan view. The tops of the removable post studs 2, 3 are shown with an appropriately-sized nut 17 attached. The bottom mounting ears 15 and the back mounting ears 16 of the mounting plate 6 are visible.

Figure 3:
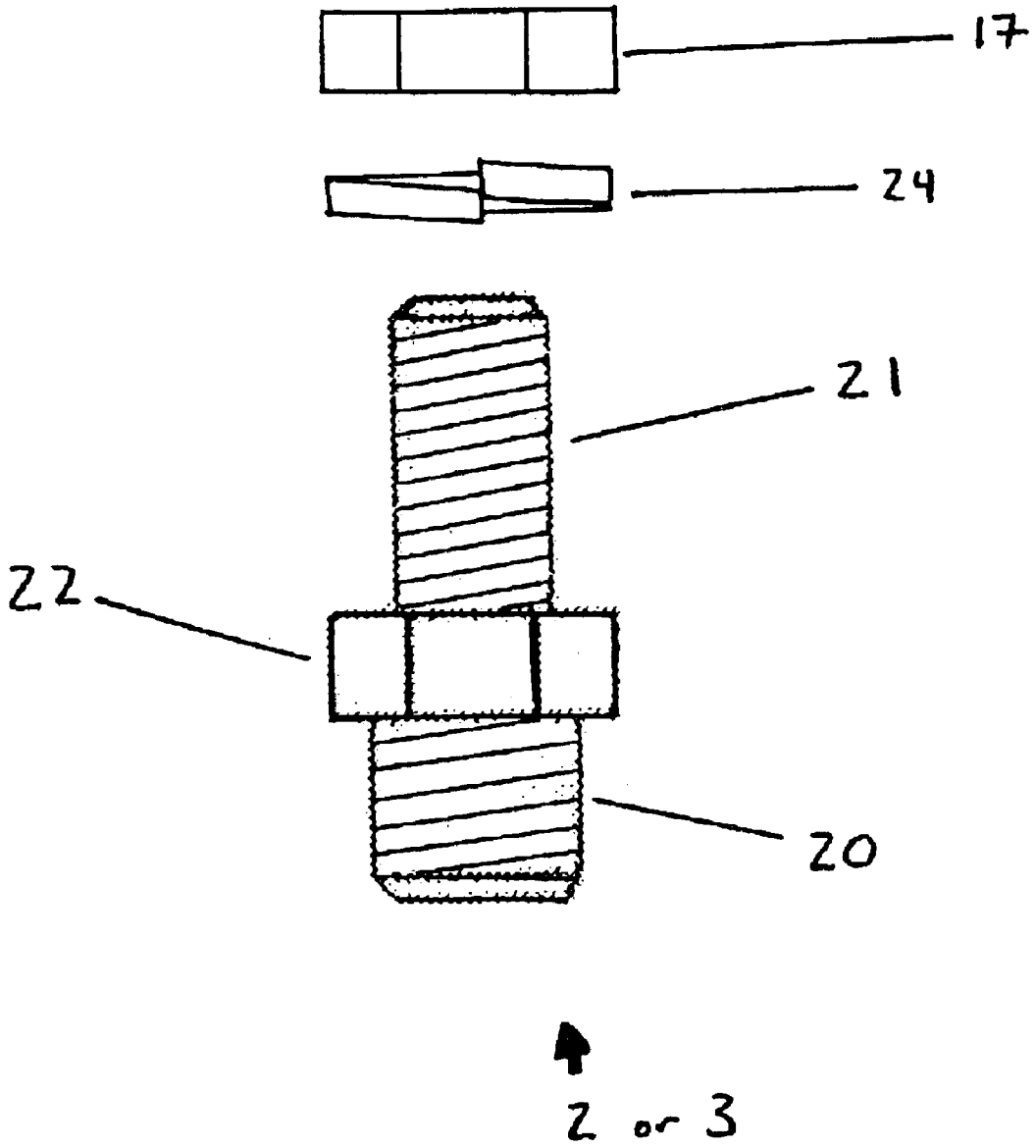
FIG. 3 is an enlarged side view of a removable post stud.

A removable post stud 2, 3 is shown in enlarged view in FIG. 3. In general, a removable post stud comprises two threaded ends 20, 21 with a flange 22 located between the two ends. As shown in FIG. 3, the flange 22 is not necessarily located at the midpoint between the two ends 20, 21, although it can be.

The insertion end 20 of the removable post stud is sized to match and screw into the female post receptors 10, 11, the size of both of which may include a common size such as 5/16". If the solenoid 1 is being used to connect with an eyelet connector (not shown) or other lead of the appropriate size for the insertion end 20, the insertion end 20 is inserted through the eyelet connector (not shown) or other lead and then screwed into the appropriate female post receptor 10, 11. The flange 22 on each removable post stud 2, 3 is used to facilitate this operation, and to hold any eyelet connector or other lead in place. The flange 22 can be formed in the shape of a hexagon or other polygon for ease of use with an appropriate tool for inserting or removing the removable post stud.

The exposed end 21 of the removable post stud is also threaded. While the exposed end 21 is ideally of a different size than the insertion end 20 for increased flexibility of use with different sizes of connectors, the exposed and insertion ends can be the same size. If the solenoid 1 is being used to connect with an eyelet connector (not shown) or other lead of the appropriate size for the exposed end 21, the eyelet connector (not shown) or other lead is placed over or around the exposed end 21 and then secured in place by an appropriately-sized nut 17. Typically, the removable post stud 2, 3 has already been screwed into the appropriate female post receptor 10, 11 prior to this operation.

The connection to either the insertion end 20 or the exposed end 21 can be secured by use of a split ring lock washer 24, a locking nut (not shown), or other form of secure fastening device. If a push-on connection is desired, the exposed end 21 can be left bare without any nut or washer. While the invention is shown in FIGS. 1–2 with two removable post studs in place, a number of removable post studs with variously-sized exposed ends, including a common size such as ¼", can be provided with a single solenoid to provide greater flexibility in application.

Figure 4:
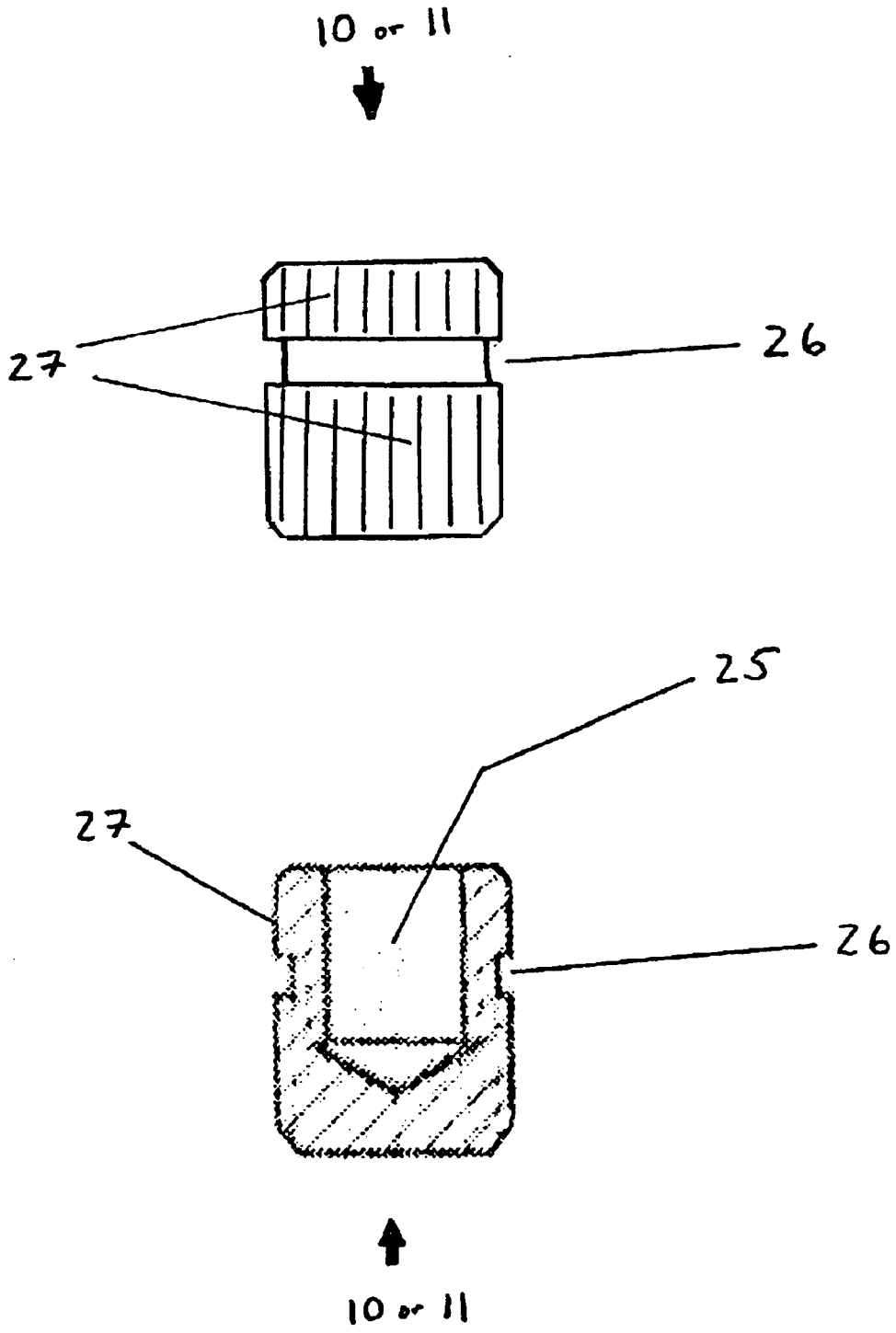
FIG. 4 is an enlarged side view and cross-sectional view of a female post receptor.

FIG. 4 shows an enlarged view of the cylindrical female post receptor 10, 11, which is integrally molded into the top of the solenoid housing 9. The inside of the cylinder 25 is threaded, and is sized to match the insertion end 20 of the removable post studs 2, 3. One or more lateral grooves 26 extend around the exterior of the female post receptor 10, 11 to assist in holding the female post receptor in place in the solenoid housing 9. These grooves can extend completely around the female post receptor 10, 11 but do not need to. A plurality of longitudinal grooves 27 extend along the exterior of the female post receptor to assist in preventing the female post receptor 10, 11 from rotating during operations, such as when the removable post stud is being inserted or removed, or when a connection is being made.

FIG. 5 is an enlarged view of an energizing terminal 4 or a ground terminal 5. The terminals are threaded. If the solenoid 1 is being used to connect with an eyelet connector or other lead (not shown) of the appropriate size for a terminal, the eyelet connector or other lead is placed over or around the terminal 4, 5 and then secured into place by an appropriately-sized nut 31. If a spade connector (not shown) is being used, a spade tab 33 is placed over the terminal 4, 5 and then secured into place by an appropriately-sized nut 31. The connection to the terminal 4, 5 can be secured against accidental loosening by use of a appropriately-sized split ring lock washer 34, a locking nut (not shown), or other form of secure fastening device. If a push-on connection is desired, the terminal 4, 5 can be left bare without any nut, washer, or spade tab other than the base nut 35.

In the illustrated embodiment of FIGS. 1–2, the electric solenoid is shown with both an energizing terminal 4 and a ground terminal 5. This is primarily suitable for use in configurations where the solenoid being replaced is externally grounded. This embodiment, however, can also be used in configurations where the solenoid being replaced is internally grounded, by electrically connecting the ground terminal 5 of the solenoid 1 to one of the bolts (not shown) used to fasten the solenoid to the frame of the equipment or vehicle in which it is being used.

Figure 6:
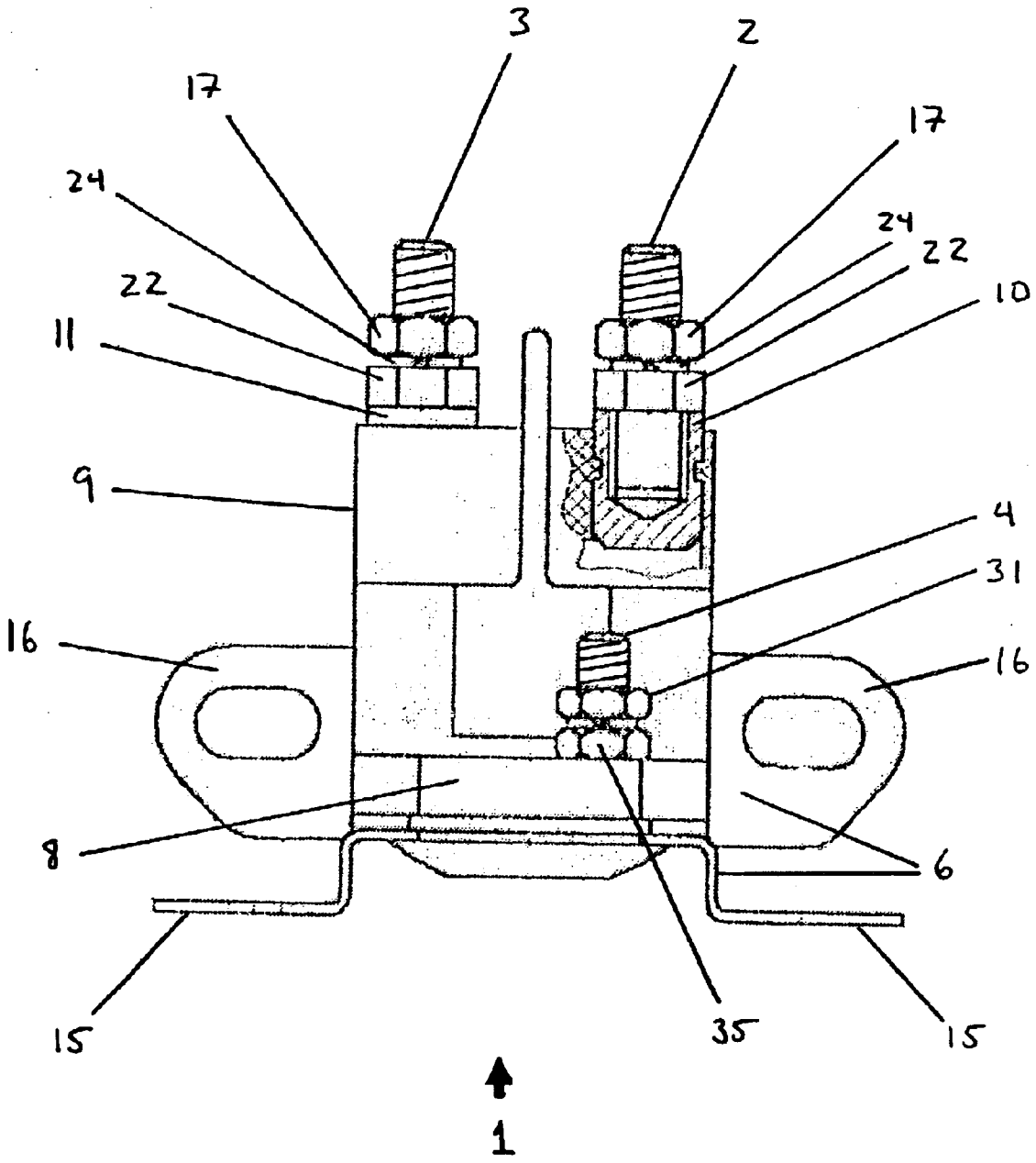
FIG. 6 is a frontal view of the solenoid shown in FIG. 1 without a ground terminal.
Figure 7:
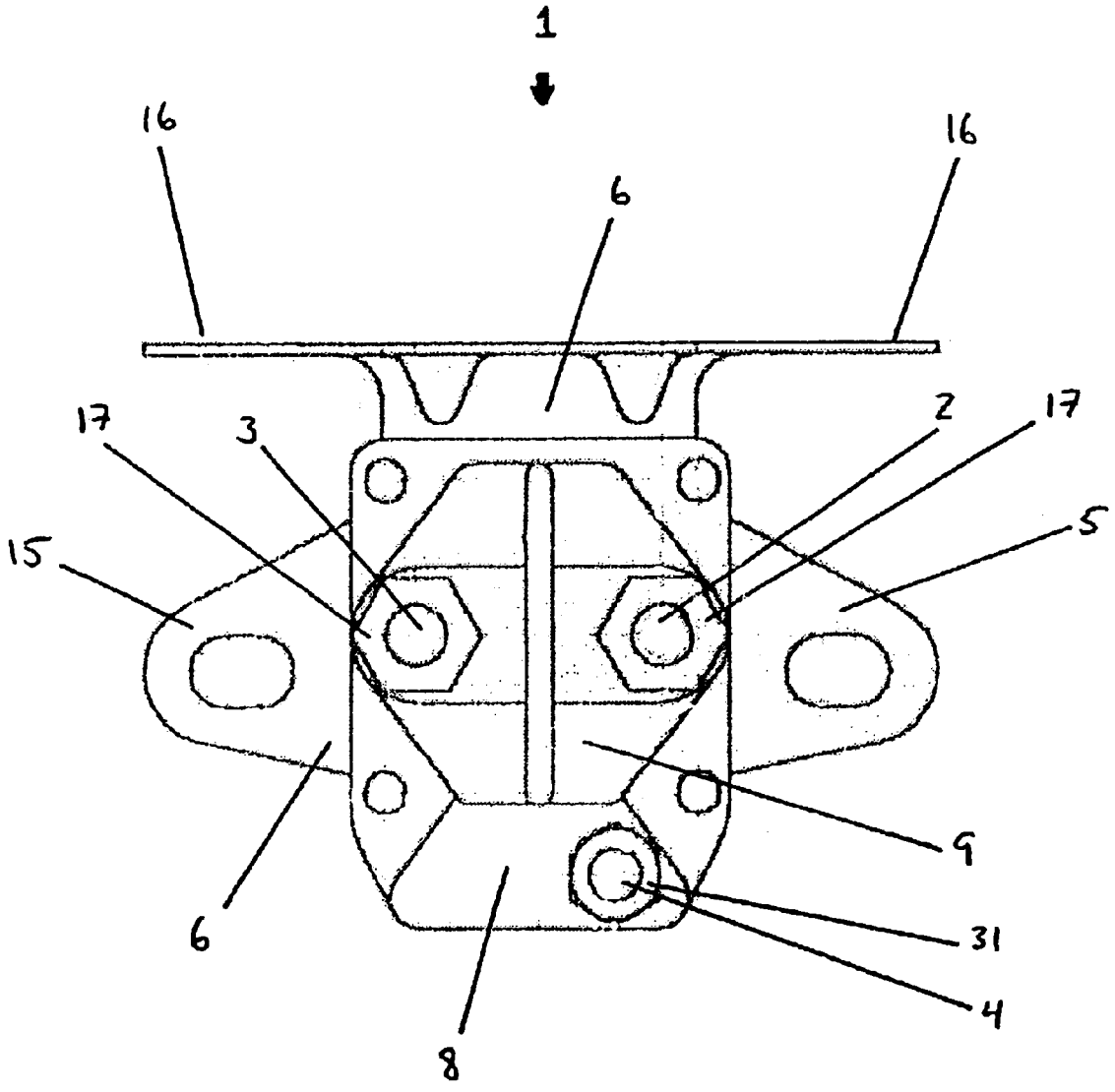
FIG. 7 is a plan view of the solenoid shown in FIG. 6.

In an alternative embodiment, as shown in FIGS. 6 and 7, the solenoid is constructed without a ground terminal 5. This embodiment is designed for configurations where external grounding is not possible or appropriate. It also has the potential to lessen confusion among users who are replacing a solenoid with no ground terminal.

Thus, it should be understood that the embodiments and examples have been chosen and described in order to best illustrate the principals of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art, including multiple combinations of different thread sizes and mounting plate configurations. Accordingly, it is intended that the scope of the invention be defined by the claims appended hereto.

We claim:

1. An electric solenoid, comprising:

a. a solenoid housing including a top end, base flange, and bottom end, and containing solenoid circuitry;

b. a first female post receptor, comprising a hollow cylinder, internally threaded, integrally molded in the top end of the solenoid housing, with an open-end and a closed-end, the open-end proximal the top end of the solenoid housing and the closed-end extending into and connected to the solenoid housing and in electrical contact with the solenoid circuitry;

c. a first removable post stud with an insertion end and an exposed end, both the insertion end and the exposed end being threaded, with the insertion end being of appropriate size to screw into the open end of the first female post receptor, and with a flange located between the insertion end and the exposed end;

d. a second female post receptor, comprising a hollow cylinder, internally threaded, integrally molded in the top end of the solenoid housing, with an open-end and a closed-end, the open-end proximal the top end of the solenoid housing and the closed-end extending into and connected to the solenoid housing and in electrical contact with the solenoid circuitry;

e. a second removable post stud with an insertion end and an exposed end, both the insertion end and the exposed end being threaded, with the insertion end being of appropriate size to screw into the open end of the second female post receptor, and with a flange located between the insertion end and the exposed end; and f. an energizing terminal with a top end and a bottom end, the top end extending from the base flange of the solenoid housing, and the bottom end extending into and connected to the solenoid housing and in electrical contact with the solenoid circuitry.

2. The electric solenoid of claim 1, further comprising a ground terminal with a top end and a bottom end, the top end extending from the base flange of the solenoid housing, and the bottom end extending into and connected to the solenoid housing and in electrical contact with the solenoid circuitry.

3. The electric solenoid of claim 1, wherein the first and second female post receptors have one or more lateral grooves on their exterior.

4. The electric solenoid of claim 1, wherein the first and second female post receptors have one or more longitudinal grooves on their exterior.

5. The electric solenoid of claim 1, wherein the exposed end of each removable post stud is the same size as the insertion end of the respective removable post stud.

6. The electric solenoid of claim 1, wherein the exposed end of each removable post stud is different in size from the insertion end of the respective removable post stud.

7. The electric solenoid of claim 1, wherein the flanges on the removable post studs are hexagonally shaped.

8. The electric solenoid of claim 1, further comprising a pair of appropriately-sized nuts to fit the exposed ends of the removable post studs.

9. The electric solenoid of claim 1, further comprising a pair of appropriately-sized nuts to fit the energizing terminal.

10. The electric solenoid of claim 9, further comprising a first spade tab to fit over and be fastened onto the energizing terminal.

11. The electric solenoid of claim 2, further comprising a pair of appropriately-sized nuts to fit the ground terminal.

12. The electric solenoid of claim 11, further comprising a second spade tab to fit over and be fastened onto the ground terminal.

13. The electric solenoid of claim 1, wherein the interiors of the first and second female post receptors are 5/16" in size, and the insertion ends of the respective removable post studs are 5/16" in size.

14. The electric solenoid of claim 1, wherein the exposed ends of the removable post studs are variably-sized, including ¼" in size.

15. The electric solenoid of claim 1, further comprising a mounting plate affixed to the bottom end of the solenoid housing, with multiple pairs of mounting ears.

16. An electric solenoid, comprising:

a. a solenoid housing including a top end, base flange, and bottom end, and containing solenoid circuitry; and b. a mounting plate affixed to the bottom end of the solenoid housing, said mounting plate further comprising multiple pairs of mounting ears, including a first pair of mounting ears extending outwardly from the solenoid housing and parallel to the bottom end of the solenoid housing for bottom mounting, and a second pair of mounting ears extending outwardly from the solenoid housing and perpendicular to the bottom end of the solenoid housing for back mounting.

* * * * *